US005655760A

United States Patent [19]

Herman

[11] Patent Number: 5,655,760

[45] Date of Patent: Aug. 12, 1997

[54] COLLATOR WITH AIR ASSISTANCE

[75] Inventor: John Lawrence Herman, Huber Heights, Ohio

[73] Assignee: Heidelberg Finishing Systems Inc., Dayton, Ohio

[21] Appl. No.: 648,206

[22] Filed: May 14, 1996

[51] Int. Cl.[6] ..... B65H 39/00

[52] U.S. Cl. ..... 270/52.26; 270/52.28

[58] Field of Search ..... 270/52.26, 52.27, 270/52.28

[56] References Cited

U.S. PATENT DOCUMENTS

| | | | |
|---|---|---|---|
| 3,572,684 | 3/1971 | Gorig | 270/52.28 |
| 3,601,388 | 8/1971 | Hilliard et al. | 270/52.28 |
| 3,809,384 | 5/1974 | Zugel | 270/52.28 |
| 3,897,051 | 7/1975 | Muller | 270/45 |
| 4,662,620 | 5/1987 | Hechler et al. | 270/52.26 |
| 4,844,433 | 7/1989 | Hastie | 270/52.27 |
| 4,901,996 | 2/1990 | Schlough | 270/52.27 |
| 4,976,420 | 12/1990 | Flensburg et al. | 270/52.28 |
| 5,354,043 | 10/1994 | Reist | 270/52.27 |

*Primary Examiner*—John T. Kwon

*Attorney, Agent, or Firm*—Tarolli, Sundheim, Covell, Tummino & Szabo

[57] ABSTRACT

A collator (10) collates folded signatures (30). A conveyor (12) of the collator (10) moves a plurality of support saddles (20). The support saddles (20) receive and support the signatures (30) with their folds extending in a direction perpendicular to a movement direction (18) of the support saddles. A feed mechanism (40) feeds a signature (30) down toward a respective support saddle (20) as the conveyor (12) moves the support saddles. The signature (30) falls vertically toward the respective support saddle (20). An air handler (66) draws air down, vertically relative to the respective support saddle (20) to minimize air resistance acting against the signature (30) being fed to the respective support saddle (20).

19 Claims, 2 Drawing Sheets

COLLATOR WITH AIR ASSISTANCE

BACKGROUND OF THE INVENTION

A known collator feeds folded sheet material signatures onto a moving conveyor. The signatures are dropped from above the conveyor onto saddle bars on the conveyor which extend perpendicular to the direction of conveyor movement. The productivity of the collator is related to the speed of the conveyor and the spacing of the bars. The conveyor speed and the bar spacing are related to the time needed for the signatures to become positioned on the bars. An open signature which is dropped with its fold uppermost "parachutes", i.e., the inside surfaces of the signature encounter air resistance and movement of the signature is slowed, which increases the time needed for the signature to become positioned on a bar.

SUMMARY OF THE INVENTION

The present invention relates to a collator for collating folded signatures. A plurality of signature support means receives the signatures. The signatures are supported by the plurality of signature support means with their folds extending in one direction. A conveyor means moves the plurality of signature support means. Preferably, the movement of the plurality of signature support means is in a direction transverse to the one direction in which the signature folds extend.

A feed means feeds a signature in a given direction to each of the signature support means as the conveyor means moves the plurality of signature support means. Preferably, the signature is fed vertically toward the respective signature support means. A means moves air in the given direction in which the signature is fed. The air is moved relative to the respective signature support means to minimize air resistance acting against the signature being fed to the respective signature support means, and thus minimize the "parachute" effect.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENT

Figure 1:
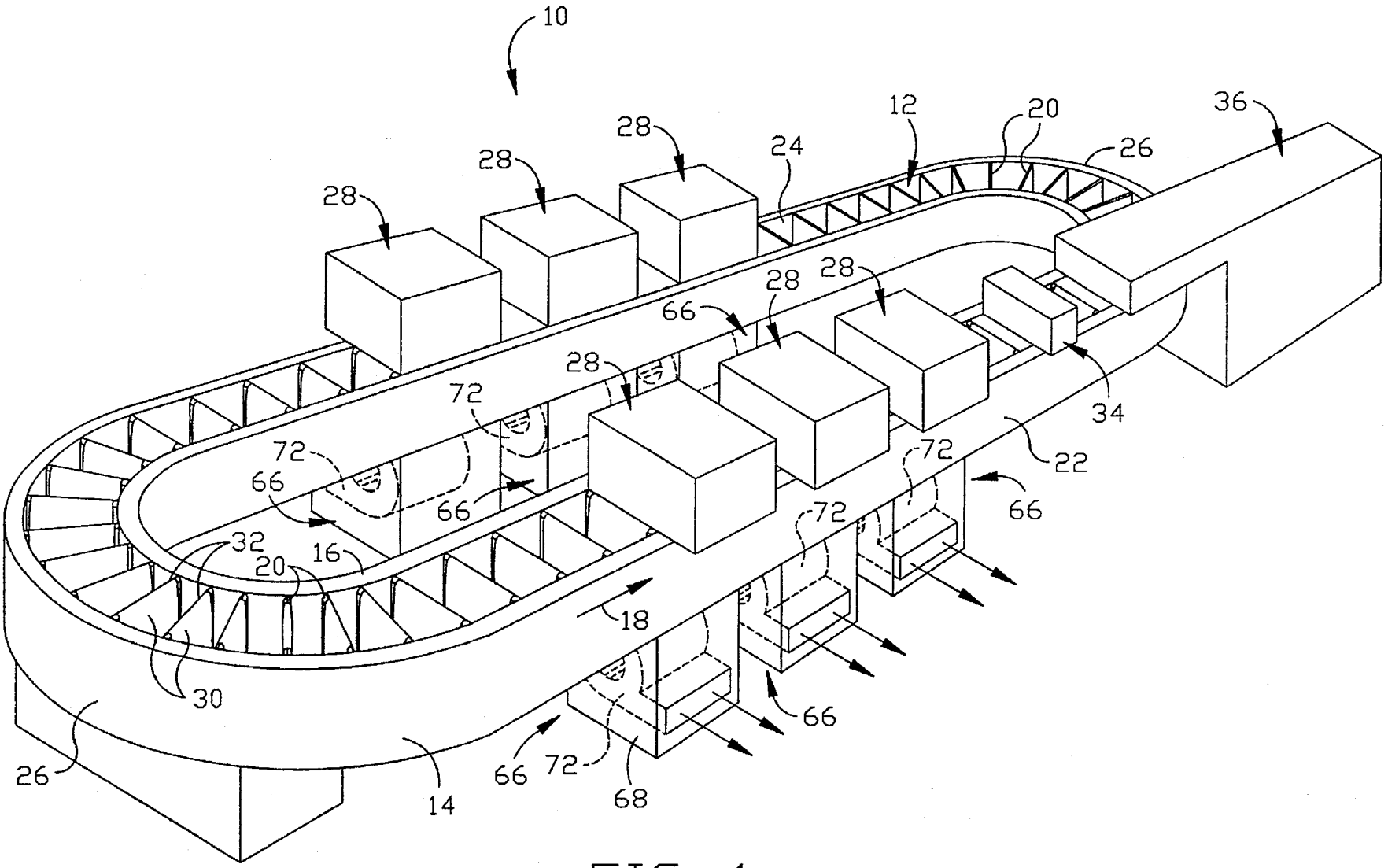
FIG. 1 is a schematic perspective view of a collator in accordance with the present invention.

The present invention is applicable to various collator constructions. As representative of such constructions, a collator 10 is schematically illustrated in FIG. 1. The collator 10 includes an oval conveyor 12 mounted in a frame 14 for horizontal movement along an oval track 16. A drive motor (not shown) moves the conveyor 12 relative to the frame 14 in a direction 18. Mounted at intervals along the conveyor 12 are a plurality of relatively closely spaced support saddles 20. Each support saddle 20 extends across the width of the conveyor 12, perpendicular to the movement direction 18 of the conveyor 12. Each support saddle 20 has a vertical extent between horizontal upper and lower edges.

The oval track 16 has two straight reaches 22 and 24 connected by curved ends 26. Mounted along each of the straight reaches 22 and 24 are a plurality of signature feed stations 28 (schematically shown). In the illustrated embodiment, there are three separate signature feed stations 28 positioned along the straight reach 22 and three separate signature feed stations 28 positioned along the straight reach 24. It should be understood that any suitable number of separate signature feed stations 28 may be provided. Each signature feed station 28 feeds a sheet material signature 30 onto each support saddle 20 as the support saddle is moved past the respective signature feed station by the conveyor 12.

Each signature 30 has a fold 32 along one edge and two sides extending from the fold. The edge of the signature 30 opposite to the fold 32 is open. The horizontal dimension of the support saddle 20 is at least as large as the length of the signature 30 along the fold 32.

As each support saddle 20 progresses along the oval track 16 past the signature feed station 28, respective signatures 30 from each of the signature feed stations are collected on the respective support saddle as a collated assemblage. Each subsequent signature 30 overlies the previous signature in the collate assemblage. Once each signature 30 is received by the respective support saddle 20, the signature is supported at the fold 32 and the two sides of the signature extend on either side of the respective support saddle. The fold 32 of each supported signature 30 is uppermost and each supported signature has the shape of an inverted "V".

Downstream from the signature feed stations 28 on the straight reach 22 is a stitching station 34 (schematically shown). The stitching station 34 stitches (staples) the collated assemblage of signatures 30 collected on each of the support saddles 20. Downstream of the stitching station 34 is a discharge station 36 (schematically shown). The stitched assemblages of signatures 30 are removed from the conveyor 12 at the discharge station 36 and moved away from the collator 10 for further handling.

Figure 2:
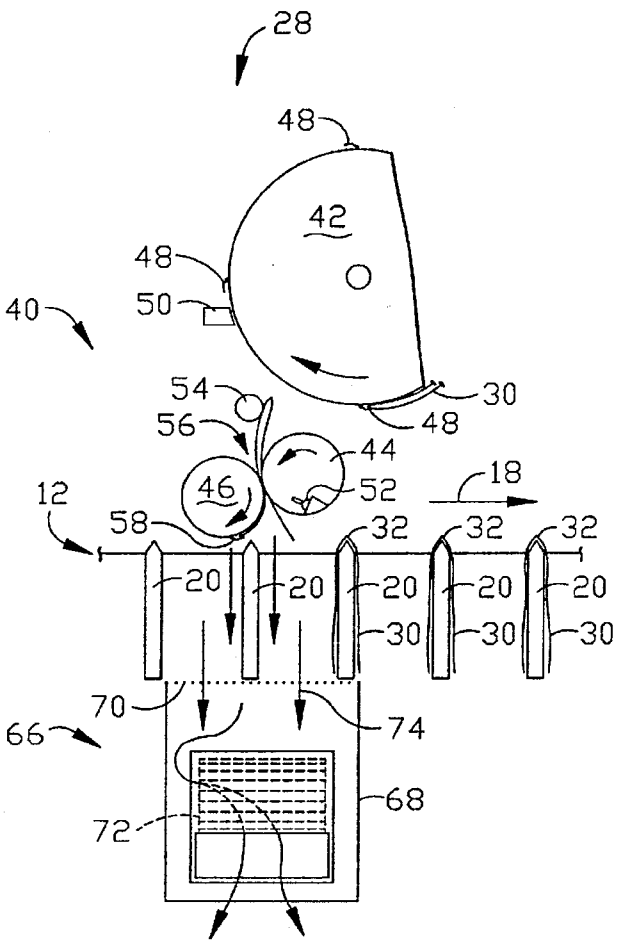
FIG. 2 is a fragmentary, schematic view of a portion of the collator of FIG. 1, with parts in a first position.

Each of the signature feed stations 28 have the same structural features. As representative of these structural features, FIG. 2 illustrates a portion of one of the signature feed stations 28. The signature feed station 28 shown in FIG. 2 is the first signature feed station past which the support saddles 20 progress during assemblage collection.

The signature feed station 28 includes a hopper (not shown) for supporting a supply of the signatures 30 which are in a closed condition. A feed mechanism 40 of the signature feed station 28 may have any suitable construction for moving a stream of the signatures 30 from the hopper and for opening the signatures such that the signatures can be received on the support saddles 20. One example of a suitable feed mechanism 40 includes an arrangement of an extractor drum 42, a transfer drum 44 and an opener drum 46. The drums 42, 44, and 46 are driven to rotate (as shown by the arrows in FIG. 2) by a mechanism (not shown).

The extractor drum 42 has a means for sequentially removing signatures from the supply of signatures in the hopper. The means for removing the signatures includes a plurality of grippers 48 mounted at equally spaced locations on the outer side of the extractor drum 42. Each gripper 48 is operable to grip one signature 30 at its fold 32. The grippers 48 sequentially move past the hopper during rotation of the extractor drum 42, and each gripper 48 grips a signature 30 and pulls the signature from the hopper.

Each signature 30 is carried, fold first, by the rotating extractor drum 42 and the respective gripper 48, in an arcuate path (clockwise, as shown in FIG. 2) about the rotational axis of the extractor drum. As the carried signature 30 is moved, the signature remains closed. The carried signature 30 is moved away from the hopper to a location above the transfer and opener drums 44 and 46. A stop 50 is located in the path of movement of the carried signature 30, and when the signature engages the stop the signature is disengaged from the gripper 48.

A gripper 52 on the transfer drum 44 engages the trailing open end of the signature 30 once the signature is disengaged from the gripper 48. As the transfer drum 44 rotates, the gripper 52 pulls the signature, open end first, past an idler roller 54 and away from the extractor drum 42. The rotating transfer drum 44 carries the still closed signature 30, open end first, about the rotational axis of the transfer drum (counter-clockwise) and into a nip 56 between the transfer and opener drums 44 and 46. At the nip 56, a gripper 58 on the opener drum 46 grips ones side of the signature 30 at the open end and the transfer drum 44 retains a hold on the other side of the signature. As the opener drum 46 rotates (clockwise) and the transfer drum 44 rotates (counter-clockwise), the signature 30 is pulled open. Once the trailing fold 32 of the signature 30 passes through the nip 56 and the signature is opened, the transfer and opener drums 44 and 46 release or drop the signature into the air such that the signature can fall with its fold uppermost.

The conveyor 12 (schematically represented in FIG. 2 by a line) extends beneath the feed mechanism 40 and the signature 30 falls toward a respective support saddle 20 on the moving conveyor. As the open signature 30 falls, one side of the signature is extended toward the support saddle immediately preceding the respective support saddle and the other side of the signature is extended toward the support saddle immediately following the respective support saddle. The inside surfaces of the open signature 30 are exposed and face down, the outside surfaces face up.

The signature feed station 28 includes an air handler 66 (schematically illustrated) located vertically beneath both the feed mechanism 40 and a portion of the conveyor 12 adjacent to the feed mechanism 40. The air handler 66 includes a housing 68 which extends to a location in close proximity to at least a portion of the support saddles 20 adjacent to the feed mechanism 40.

The housing 68 has an opening at its upper end which faces the support saddles 20. Preferably, the opening of the housing 68 has a width, as measured perpendicular to the direction 18, at least equal to the width of the support saddles 20 and a length, as measured parallel to the direction 18, equal to a distance along three adjacent support saddles. A screen 70 extends across the opening in the housing 68.

A fan 72 is located within the housing 68 and is driven by a motor (not shown). Preferably, the fan 72 is a squirrel cage type fan which has an intake located within the housing 68 and a discharge exhaust directed out from the housing at a location remote from the conveyor 12. The fan 72 creates an air flow 74. The air flow 74 is air drawn downward past the support saddles 20 on the conveyor 12, through the screen 70 and through the housing 68. The vertical length of the support saddles 20 and the close proximity of the moving support saddles to the screened opening in the housing 68 help channel the air flow 74. Preferably, the air flow 74 moves vertically past the support saddles 20 at a velocity at least as great as the velocity of the signature 30 falling onto the respective support saddle 20. For example, the air flow 74 may have a velocity of 120% of the falling velocity of the signature 30.

Air is drawn from beneath the falling signature 30 and from between the sides of the signature, and the air pressure against the exposed inside surfaces of the signature is reduced to create a slight vacuum or negative pressure. The air pressure on the exposed, downward facing inside surfaces of the signature 30 is less than the air pressure on the upward facing outside surfaces of the signature. A downward drawing force is applied to the signature 30 by the air flow 74 and the downward force helps draw the signature 30 down.

The air flow 74 minimizes the air resistance against the falling signature 30 and reduces the "parachute" effect. Also, the difference in air pressures against the inside and outside surfaces of the signature 30 helps urge the signature to close as the signature falls onto the support saddle 20. The signature 30 falls onto the support saddle 20 in a rapid, smooth and expedient fashion.

Figure 3:
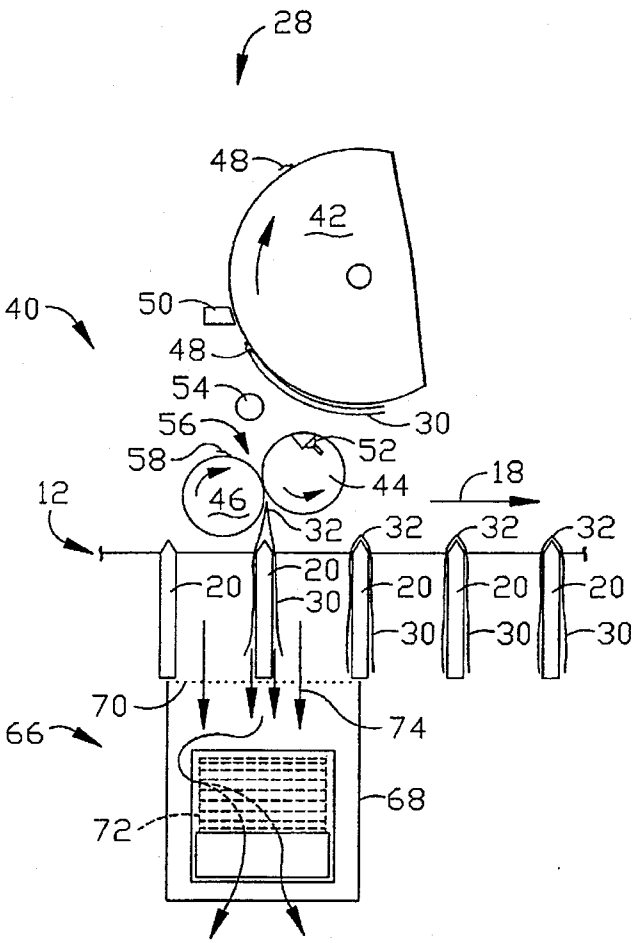
FIG. 3 is a view similar to FIG. 2, but with parts in a second position.

The falling time is minimized so that the respective support saddle 20 moves only a relatively short distance in the direction 18 after the signature 30 begins to fall and before the signature is positioned on the support saddle 20 (FIG. 3). Problems such as a missed landing of the signature 30 on the support saddle 20 are minimized. Each subsequent signature feed station 28 will similarly feed a respective signature 30 on top of the previous signature 30 on the support saddle 20.

As each sequential support saddle 20 is moved past a signature feed station 28, another signature 30 is fed and released by the feed mechanism 40 and efficiently lands. A typical operation rate for the collator 10 is at least 300 signatures per minute at each of the signature feed stations 28.

From the above description of the invention, those skilled in the art will perceive improvements, changes and modifications. Such improvements, changes and modifications within the skill of the art are intended to be covered by the appended claims.

Having described the invention, the following is claimed:

1. A collator for signatures, said collator comprising:

a plurality of signature support means for receiving signatures;

conveyor means for moving said plurality of signature support means;

feed means for feeding a signature in a given direction to each of said signature support means as said conveyor means moves said plurality of signature support means; and means for moving air in the given direction relative to one of said plurality of signature support means to minimize air resistance acting against a respective signature being fed to said one signature support means.

2. A collator as set forth in claim 1, wherein said feed means includes means for releasing the respective signature to fall vertically toward said one signature support means, said means for moving air includes means for drawing the air downward relative to said one signature support means to minimize air resistance acting against the respective signature falling toward said one signature support means.

3. A collator as set forth in claim 2, wherein said means for moving air includes means for moving the air at least as fast as the signature is falling.

4. A collator as set forth in claim 3, wherein the air is moved at a velocity of 120% of the falling velocity of the signature.

5. A collator as set forth in claim 2, wherein the signatures are folded and have a folded edge and two sides extending from the folded edge, said feed means includes means for releasing the respective signature to fall vertically toward said one signature support means with its folded edge uppermost.

6. A collator as set forth in claim 5, wherein said means for moving air creates a negative pressure between the sides of the falling signature.

7. A collator as set forth in claim 1, wherein said means for moving air includes a blower drawing the air past at least a portion of said plurality of signature support means.

8. A collator as set forth in claim 7, wherein said blower is located below said conveyor means.

9. A collator as set forth in claim 7, wherein said blower exhausts air at a location remote from said conveyor means.

10. A collator as set forth in claim 1, wherein each of said plurality of signature support means is elongate in the given direction for channeling air flow.

11. A collator as set forth in claim 1, wherein the signatures are folded, said plurality of signature support means includes means for supporting the signatures with their folds extending in one direction, said conveyor means includes means for moving said plurality of signature support means in a direction transverse to the one direction in which the folds extend.

12. A collator for collating a plurality of folded signatures, said collator comprising:

a plurality of signature support means for receiving folded signatures and for supporting the folded signatures with their folds extending in a given direction;

conveyor means for moving said plurality of signature support means in a direction transverse to the given direction;

feed means for causing a folded signature to fall vertically toward each of said signature support means as said conveyor means moves said plurality of signature support means; and means for moving air vertically relative to one of said plurality of signature support means to minimize air resistance acting against a respective signature falling toward said one signature support means.

13. A collator as set forth in claim 12, wherein said means for moving air includes means for moving the air at least as fast as the signature is falling.

14. A collator as set forth in claim 12, wherein the signatures are folded at an edge, said feed means includes means for releasing the respective signature to fall with its fold edge uppermost.

15. A collator as set forth in claim 14, wherein each signature has two sides extending from the folded edge, said means for moving air creates a negative pressure between the sides of the falling signature.

16. A collator as set forth in claim 12, wherein said means for moving air includes a blower drawing the air past at least a portion of said plurality of signature support means.

17. A collator as set forth in claim 12, wherein each of said plurality of signature support means is elongate vertically for channeling air flow.

18. A collator as set forth in claim 12, wherein said means for moving air includes means for moving the air at a velocity greater than a falling velocity of the signature.

19. A collator as set forth in claim 18, wherein the air is moved at a velocity of 120% of the falling velocity of the signature.

* * * * *